US011618627B1

(12) United States Patent
Pierson et al.

(10) Patent No.: US 11,618,627 B1
(45) Date of Patent: Apr. 4, 2023

(54) SAFETY VALVE LOCKING DEVICE

(71) Applicant: Pierson Industries, Inc., Rockaway, NJ (US)

(72) Inventors: Theodore J. Pierson, Rockaway, NJ (US); Stephane Orofino, Boonton, NJ (US)

(73) Assignee: Pierson Industries, Inc., Rockaway, NJ (US)

( * ) Notice: Subject to any disclaimer, the term of this patent is extended or adjusted under 35 U.S.C. 154(b) by 0 days.

(21) Appl. No.: 18/092,705

(22) Filed: Jan. 3, 2023

Related U.S. Application Data

(60) Provisional application No. 63/296,189, filed on Jan. 4, 2022.

(51) Int. Cl.
*B65D 83/22* (2006.01)

(52) U.S. Cl.
CPC ..... *B65D 83/22* (2013.01)

(58) Field of Classification Search
CPC ... B65D 83/22; B65D 83/222; B65D 2215/02
See application file for complete search history.

(56) References Cited

U.S. PATENT DOCUMENTS 2,559,815 A * 7/1951 Woodward ..... G01F 11/28 222/153.14
3,272,390 A * 9/1966 Horwitt ..... A62C 13/006 222/394
3,828,982 A 8/1974 Steigerwald
3,837,537 A 9/1974 Baldwin
3,894,665 A 7/1975 Swenson
3,918,614 A * 11/1975 Steiman ..... B65D 83/222 222/402.13
3,940,023 A 2/1976 Umstead
3,963,152 A * 6/1976 Landsman ..... B65D 83/40 222/402.13
4,427,134 A * 1/1984 Almouli ..... B65D 83/226 222/402.11
4,582,228 A * 4/1986 Diamond ..... B65D 83/48 222/402.11
5,131,569 A * 7/1992 Hodgson ..... B65D 83/75 222/401

(Continued)

*Primary Examiner* — Frederick C Nicolas
(74) *Attorney, Agent, or Firm* — John H. Choi & Associates

(57) ABSTRACT

A child-resistant assembly includes a collar member for coupling to a container. The collar member includes an upper wall, opposing passageways on the upper wall, opposing biasing members and a slide member integrally formed. The slide member extends longitudinally through the opposing passageways and includes a longitudinal slot and a pair of lateral slots formed along the longitudinal slot, with a stop member formed between the pair of lateral slots. The assembly also includes an intermediate member positioned on the collar member and includes a locking member extending downwardly therefrom. The locking member is configured to be positioned within each of the pair of lateral slots. In a rested state, the locking member is prevented from downward movement by the stop member. In an engaged state, the locking member can be positioned within a lateral slot and material from the container is capable of being discharged.

20 Claims, 14 Drawing Sheets

(56) References Cited

U.S. PATENT DOCUMENTS

| | | | | |
|---|---|---|---|---|
| 5,282,551 | A | 2/1994 | Pierson | |
| 5,520,305 | A | 5/1996 | Pierson | |
| 7,588,171 | B2 * | 9/2009 | Reedy | B65D 83/22 222/402.11 |
| 10,744,520 | B1 * | 8/2020 | Meshberg | A61M 15/08 |

* cited by examiner

DETAILS OF A

SAFETY VALVE LOCKING DEVICE

CROSS-REFERENCE TO RELATED APPLICATION

This application claims priority to U.S. Provisional Application No. 63/296,189 titled "Child-Resistant Container," filed on Jan. 4, 2022, which is incorporated by reference in its entirety.

FIELD

The present invention relates to child-resistant containers and more specifically to child-resistant assemblies for use on spray bottles or cans.

BACKGROUND

Pressurized containers, such as aerosol cans, are commonly used to store and dispense a wide variety of household products such as cleaners, insecticides, paints, cosmetic aids, and the like. These products are generally used by spraying them directly onto their intended target. As can be appreciated, the use of aerosol cans for dispensing such products is desirable in many ways since these products can be used quickly and effortlessly. However, frequently the products dispensed from aerosol cans are toxic especially if ingested or applied to eyes, lungs, or other sensitive areas of anatomy.

The chances of someone being injured because of coming into contact with products dispensed from aerosol cans are greatly enhanced if the aerosol can is used by children.

It is common knowledge that children tend to be inquisitive and if given the opportunity, they will explore or play with various household items left within their reach. Accordingly, hundreds of serious, unnecessary accidents occur every year as a result of unattended children who inadvertently spray a dangerous product from a pressurized container. Thus, a great need exists for effective childproof safety locking devices to solve the problem of inadvertent actuation of pressurized containers.

Safety locking devices to prevent or reduce the likelihood of a child spraying the contents of an aerosol can are known. In fact, considerable effort has been devoted to development of an economical and effective safety valve locking device. Notwithstanding the effort expended to develop such a device, the structure and operation of prior childproof safety locking devices adapted to selectively permit or prohibit depression of an actuator head on a movable valve stem for pressurized containers have shortcomings which have been surmounted by the present invention.

For example, efforts have been made prior to this invention to develop a safety cap for placement over the dispensing mechanism of pressurized cans. However, these safety caps have proven to be undesirable for use as a childproof device. This is due in part to the fact that users of spray products often forget to replace the caps after the product has been used. Thus, if a user inadvertently forgets to replace the cap, the safety caps are rendered entirely ineffective for their intended purpose.

Other past attempts have resulted in childproof safety locking devices arranged to selectively prevent dispensing the contents of an aerosol can. However, attempts also contain several shortcomings. For example, many of these devices include intricate designs which are expensive to manufacture are difficult to assemble or, lend themselves to defective design or have parts that are easily susceptible to fatigue and breakdown of their elastic memory. Other significant shortcomings of prior art devices include structures that are so simple that a young child can figure out how to operate the supposedly childproof safety locking device or actuate the valve that dispenses the spray merely by "playing" with the can and the safety locking devices thereon. Thus, these devices are also completely defective for their intended purpose. Still other prior art locking devices are defective because they contain the serious drawback of not automatically reverting to their locking position once the user has finished spraying the contents from the associated pressurized can. Thus, if the user forgets to place the locking device in its locking position after using the desired product, a young child can actuate the valve assembly thereof. This drawback also renders these locking devices entire ineffective. Examples of prior art devices having some of the foregoing drawbacks can be found in U.S. Pat. No. 3,828,982 to Steigerwald; U.S. Pat. No. 3,940,023 to Umstead; U.S. Pat. No. 3,837,537 to Baldwin; and U.S. Pat. No. 3,894,665 to Swenson.

Plainly, despite the great effort expended by prior art designers and manufacturers of safety locking devices for valve assemblies in the pressurized can art, many drawbacks still exist. It is evident from the existence of such drawbacks that there has been a considerable need for an improved safety locking device valve assemblies used for dispensing the contents of pressurized containers which is effective, inexpensive to manufacture and will automatically revert to the locked position when use of the pressurized container is complete. Furthermore, there is also a longstanding but unsolved need for a locking device comprising an adaptable collar for use with any pressurized container.

The invention described in U.S. Pat. No. 5,282,551 (the "'551 Patent"), which is incorporated by reference, solved the problems of the prior art at that time. While the '551 Patent offers many advantages, one of the disadvantages is that modifications are necessary to accommodate for both right-handed and left-handed users due to the position of the slide member. Therefore, a need exists for a child-resistant container adapted for both right-handed and left-handed users without modification.

The present invention solves the aforementioned problem by using a safety valve locking device having a new and unobvious structure and operation. Accordingly, the safety valve locking device of the present invention will benefit all individuals who are concerned that young children may injure themselves by dispensing the contents of pressurized containers in an undesirable manner.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The child-resistant container of the present invention is an improvement of the invention described in the '551 Patent. Specifically, the safety valve locking device of the present invention provides an apparatus adapted for both right-handed and left-handed users without modification.

In aspect, the present invention provides a safety valve locking device comprising: a collar member configured to be attached to a rim of a can, the collar member comprising: an upper wall comprising inner and outer surfaces; opposing passageways extending through the upper wall, wherein the upper wall inner surface is engaged with the rim; opposing biasing members integrally formed with and extending radially inward from the upper wall inner surface; and a slide member integrally formed with and positioned laterally between the opposing biasing members, the slide member having opposing ends and extending longitudinally through the opposing passageways; wherein the slide member further comprises: an engagement member extending from each opposing end; a longitudinal slot extending intermediate the opposing ends; a pair of lateral slots formed along the longitudinal slot with a stop member formed between the pair of lateral slots; and at least one stop tab extending laterally outwardly from the slide member; an intermediate member positioned on the collar member, the intermediate member comprising: a top member having opposing upper and lower surfaces; an upper aperture extending through the top member; a locking member extending downwardly from the lower surface, the locking member configured to be positioned within each of the pair of lateral slots; a side wall extending downwardly from and circumscribing the top member; and first and second opposing cut-outs on the side wall, wherein a bottom end of the side wall is slidably coupled with the collar member upper wall outer surface, and wherein each cut-out is positioned directly above the slide member; and a valve assembly comprising: a vertically extending valve stem; and an actuator head operably coupled to the valve stem at an upper end thereof, wherein the valve stem extends through the upper aperture and into the can, and the actuator head extends above the intermediate member; wherein in a rested state, the locking member is positioned directly above the stop member such that the intermediate member is prevented from downward movement; and wherein in an engaged state, the engagement member is engaged radially inward such that the locking member is positioned directly above one of the pair of lateral slots, such that when the actuator head is engaged downward, the locking member is positioned within the lateral slot and material from the can is capable of being discharged from the actuator head.

In another aspect, the present invention provides a safety valve locking device comprising: a collar member configured to be attached to a rim of a can, the collar member comprising: an upper wall comprising inner and outer surfaces; opposing passageways extending through the upper wall, opposing biasing members integrally formed with and extending radially inward from the upper wall inner surface; and a slide member integrally formed with and positioned laterally between the opposing biasing members, the slide member having opposing ends and extending longitudinally through the opposing passageways; wherein the slide member further comprises: an engagement member extending from each opposing end; a longitudinal slot extending intermediate the opposing ends; and a pair of lateral slots formed along the longitudinal slot with a stop member formed between the pair of lateral slots; and an intermediate member positioned on the collar member, the intermediate member comprising: a top member having opposing upper and lower surfaces; an upper aperture extending through the top member; a locking member extending downwardly from the lower surface, the locking member configured to be positioned within each of the pair of lateral slots; a side wall extending downwardly from and circumscribing the top member; and first and second opposing cut-outs on the side wall, wherein each cut-out is positioned directly above the slide member; wherein in a rested state, the locking member is positioned directly above the stop member such that the intermediate member is prevented from downward movement; and wherein in an engaged state, the engagement member is engaged radially inward such that the locking member is positioned directly above one of the pair of lateral slots, such that when the intermediate member is engaged downward, the locking member is positioned within the lateral slot and material from the can is capable of being discharged from the can.

In yet another aspect, the present invention provides a child-resistant assembly comprising: a collar member configured to be coupled with a container, the collar member comprising: an upper wall comprising inner and outer surfaces; opposing passageways extending through the upper wall, opposing biasing members extending radially inward from the upper wall inner surface; and a slide member positioned laterally between the opposing biasing members, the slide member having opposing ends and extending longitudinally through the opposing passageways; wherein the slide member further comprises: a longitudinal slot extending intermediate the opposing ends; and a pair of lateral slots formed along the longitudinal slot with a stop member formed between the pair of lateral slots; and an intermediate member positioned on the collar member, the intermediate member comprising: a top member having opposing upper and lower surfaces; and a locking member extending downwardly from the lower surface, the locking member configured to be positioned within each of the pair of lateral slots; wherein in a rested state, the locking member is positioned directly above the stop member such that the intermediate member is prevented from downward movement; and wherein in an engaged state, the slide member is engaged radially inward such that the locking member is positioned directly above one of the pair of lateral slots, such that when the intermediate member is engaged downward, the locking member is positioned within the lateral slot and material from the container is capable of being discharged from the container.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 1A:
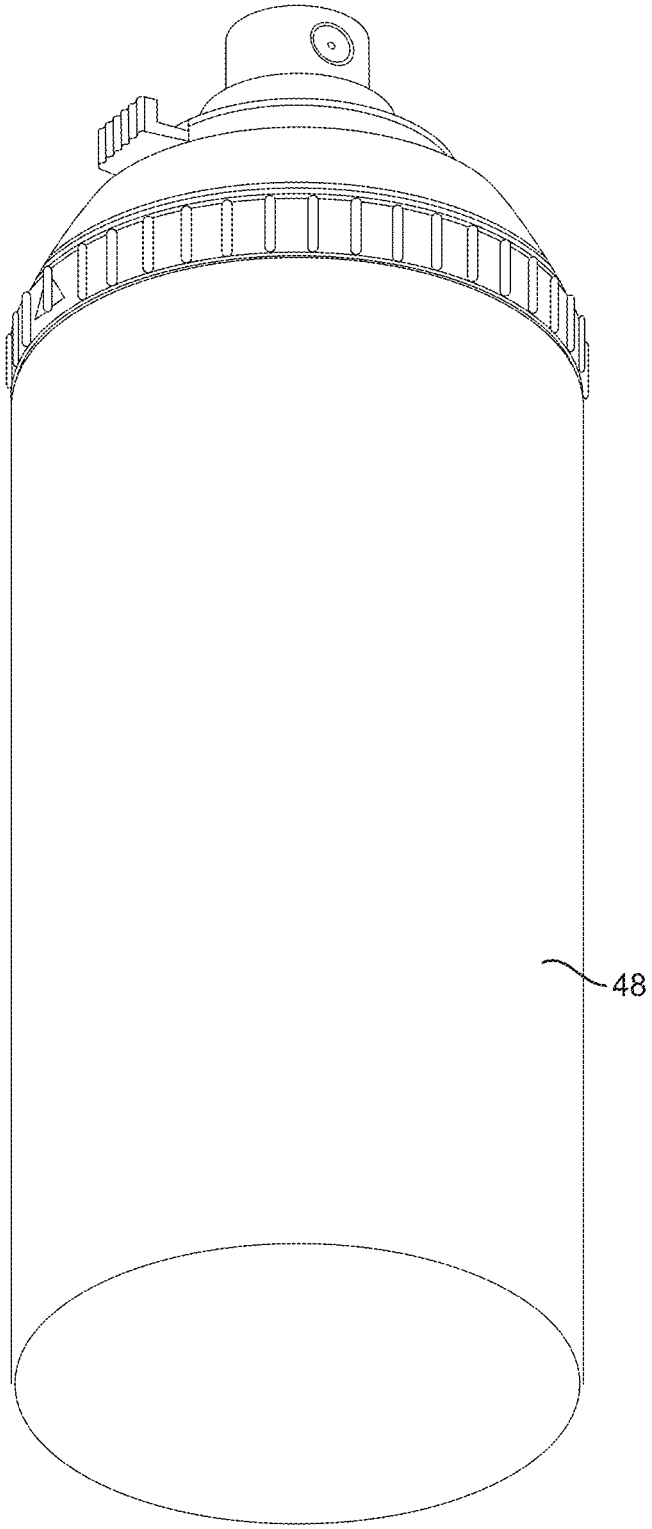
FIGS. 1A-1C show exploded bottom perspective views of the components of an embodiment of the child-resistant assembly or safety valve locking device of the present invention.
Figure 1B:
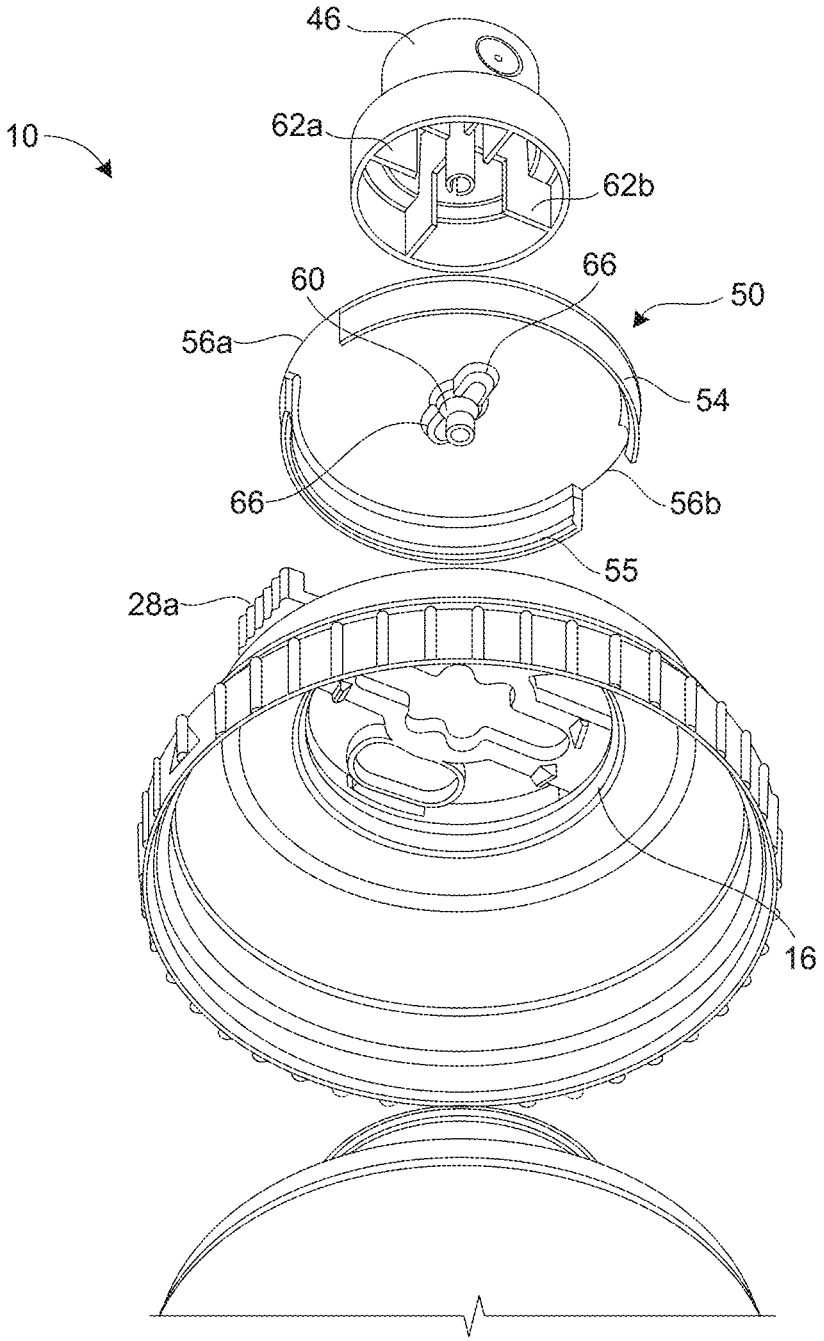
Figure 1C:
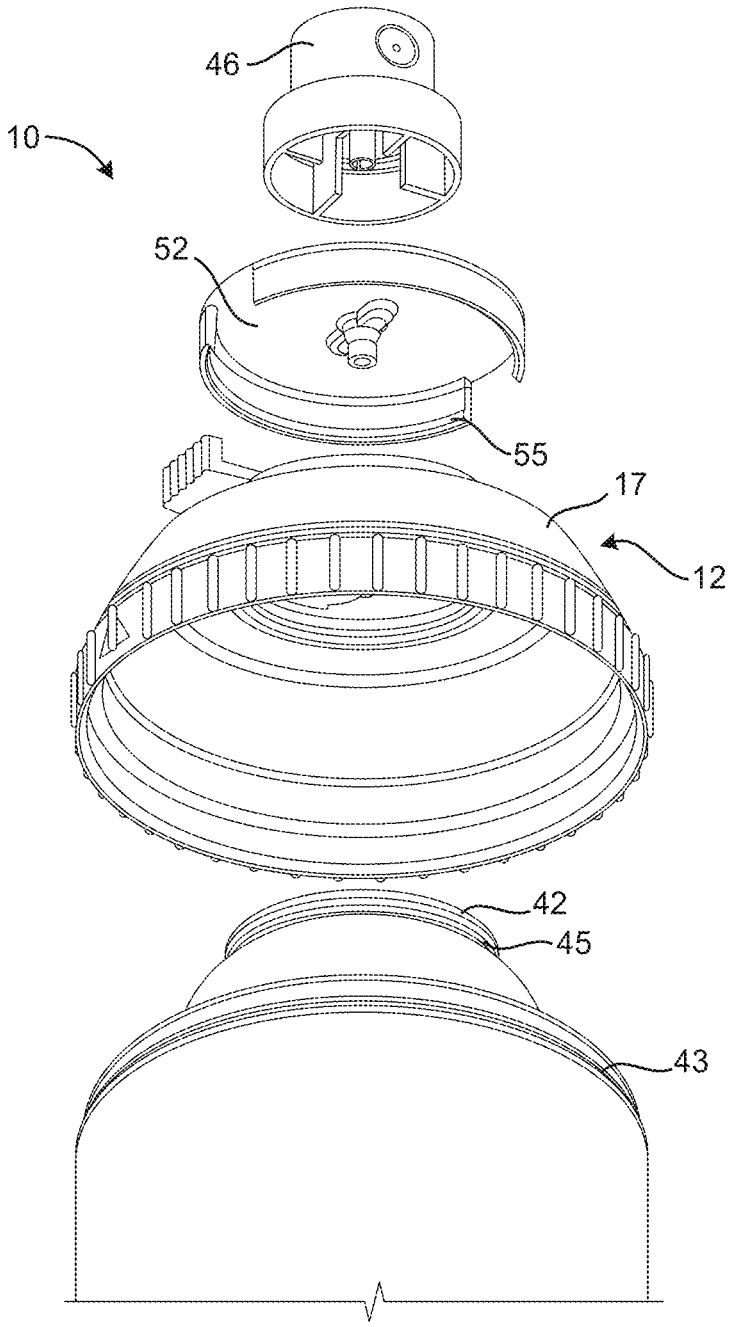
Figure 2A:
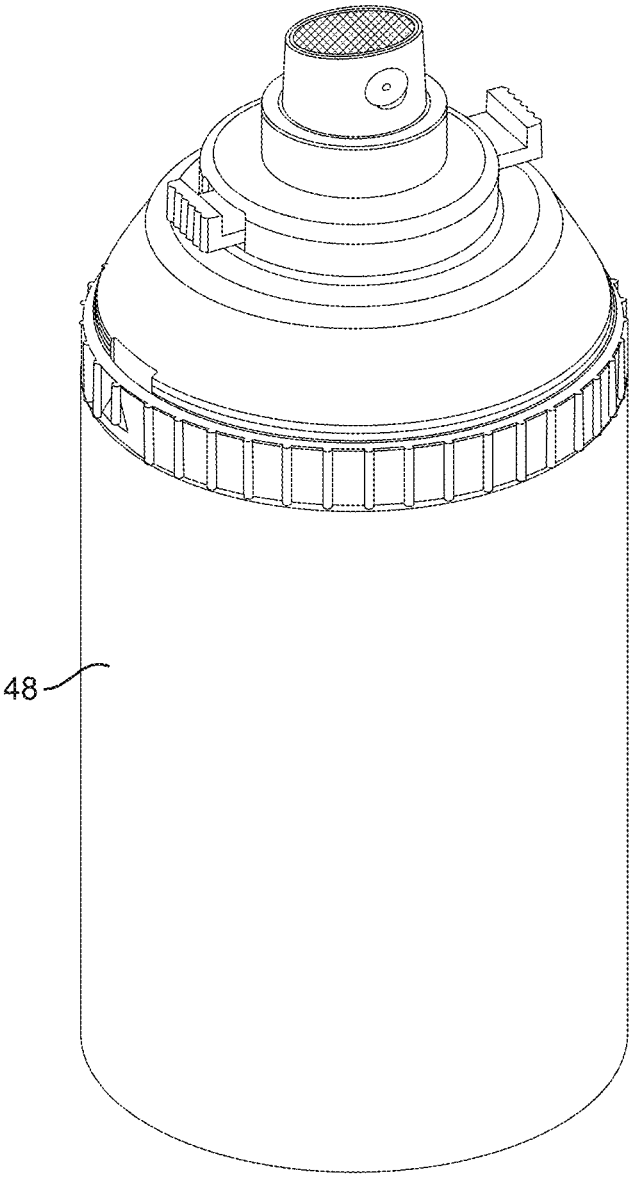
FIGS. 2A-2C show exploded top perspective views of the components of the safety valve locking device of FIG. 1.
Figure 2B:
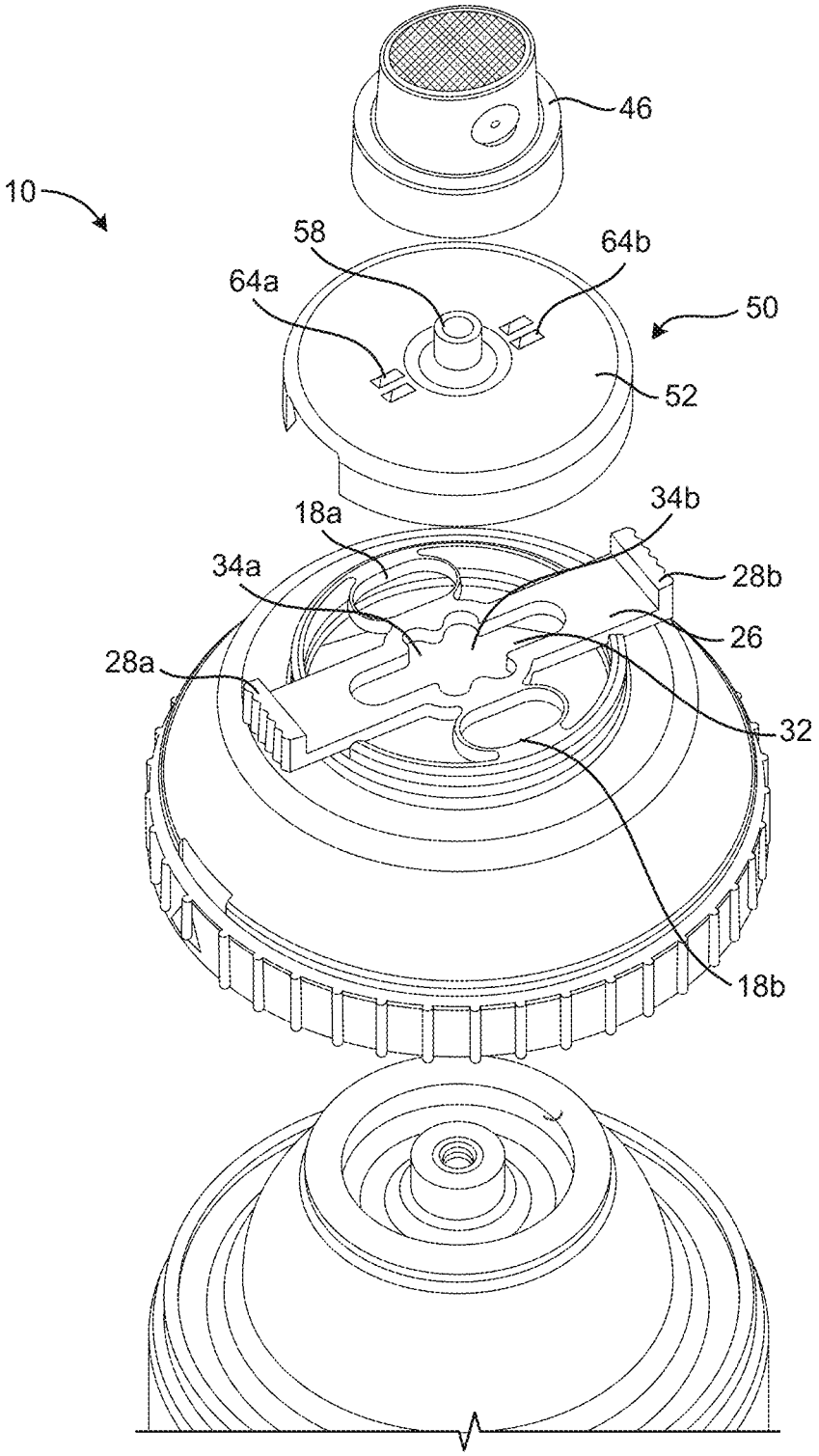
Figure 2C:
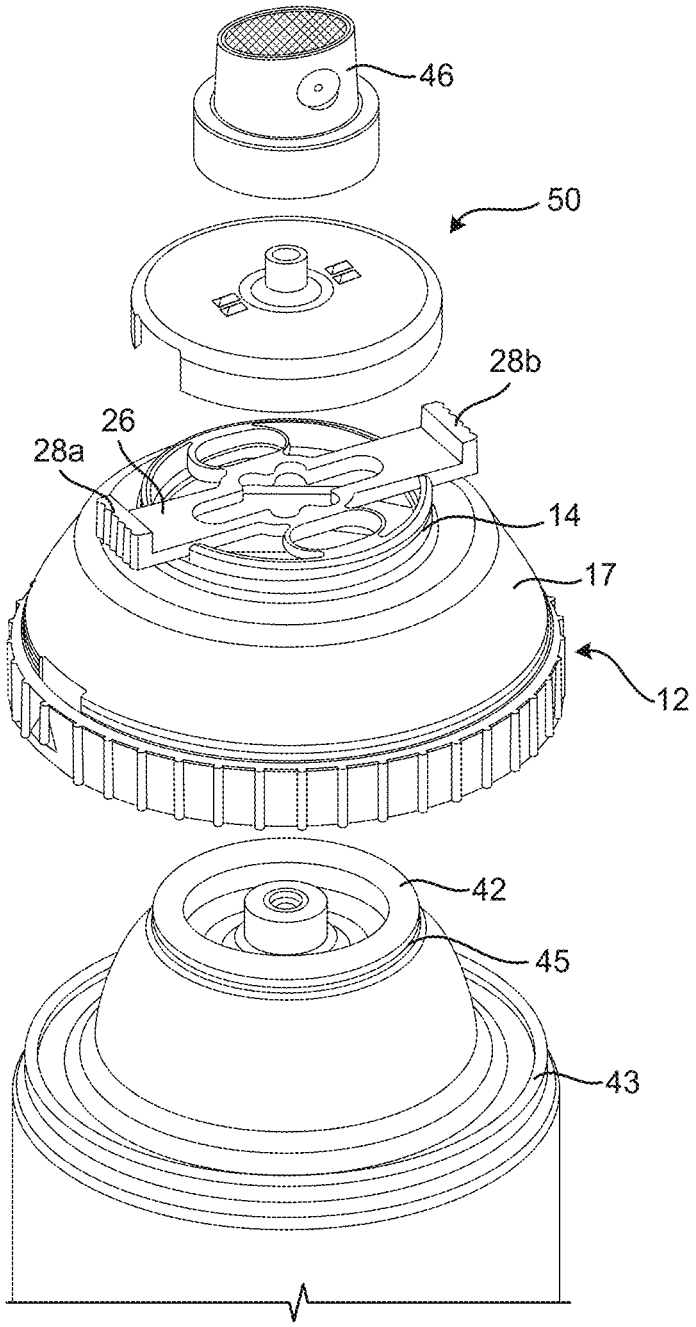

To facilitate an understanding of the invention, identical reference numerals have been used, when appropriate, to designate the same or similar elements that are common to the figures. Further, unless stated otherwise, the features shown in the figures are not drawn to scale and are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left are used to describe the accompanying figures. The terminology includes the words above specifically mentioned, derivatives thereof, and words of similar import.

Several embodiments of the present invention are shown in the figures. First, the safety valve locking device 10 of the present invention is adapted to be used for containers with both smaller actuator heads (e.g., FIGS. 4A-7) and larger actuator heads (e.g., FIGS. 8 and 9). Second, the safety valve locking device 10 of the present invention can be configured to be used alone (e.g., FIGS. 4A-6B and 8) and to be used in combination with a child-resistant cap (e.g., FIGS. 7 and 9), as described in U.S. Pat. No. 5,520,305 (the "305 Patent"), which is incorporated by reference, and further illustrated in FIG. 10.

Referring to FIGS. 4A-6B and 8, the safety valve locking device generally designated 10 includes a sized and shaped collar member or collar 12 adapted to fit over a rim 42 of a valve assembly for an aerosol can 48. The collar 12 includes an upper wall 13 having an outer surface 14 and an inner surface 16. A lower end of the inner surface 16 includes a detent 15 extending along the inner surface 16 and facing radially inward. The detent 15 is sized and shaped to fit in a groove 45 formed under the rim 42 for a press-fit engagement. It is preferable for the inner surface 16 of the collar 12 to be press-fitted onto the rim 42 of an aerosol can 48 when the safety valve locking device 10 is in assembled form. The collar 12 is sized and shaped to be universally adaptable to fit over a "standard" sized valve rim. Thus, the safety locking device 10 can be used with any sized pressurized container including a "standard" sized valve rim. According to this aspect of the present invention, the term "standard sized valve rim" pertains to a valve rim having an outer diameter of approximately 32.4 mm. As can be appreciated, the inner diameter of the collar 12 of the safety valve locking device 10 is not limited in size to correspond with the foregoing diameter of a standard sized valve rim. As will be discussed further hereinbelow, so long as the inner diameter of the collar 12 is adapted to accommodate a friction fit with respect to the rim 42, the size of the pressurized container is irrelevant. Thus, the safety valve locking device 10 is "universal." As shown in FIG. 3, the upper wall outer surface 14 includes a groove 19 extending along the outer surface 14. That is, an upper portion of the upper wall 13 extends slightly further radially outward than a lower portion of the upper wall 13, as shown, for example, in FIGS. 4-6.

Figure 7:
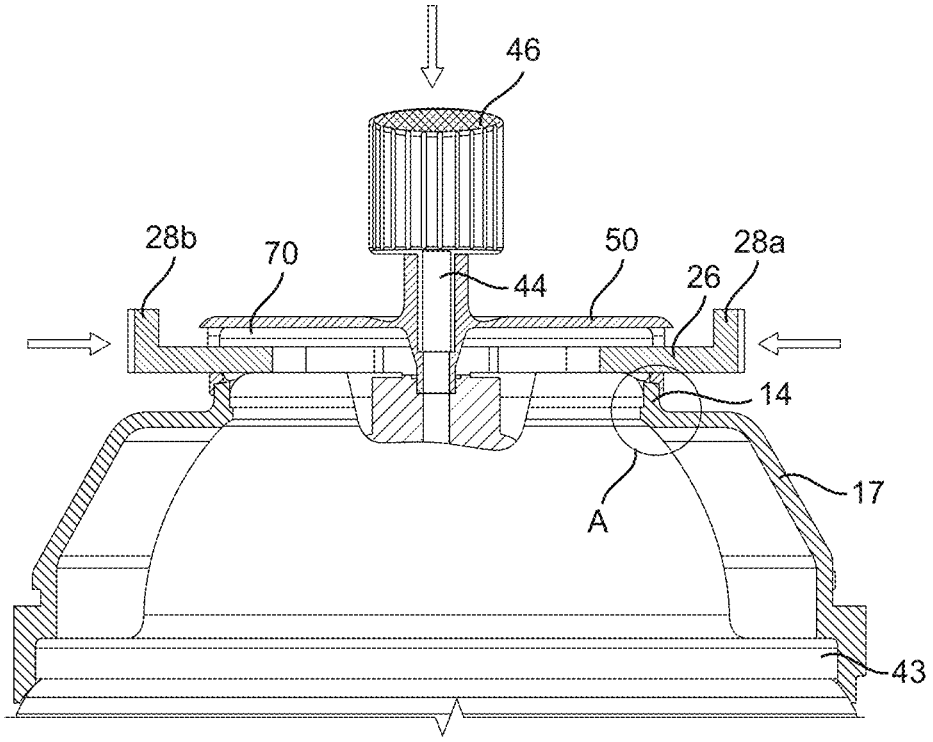
FIG. 7 shows rear sectional views of another embodiment of the safety valve locking device of the present invention in a rested state.
Figure 7:
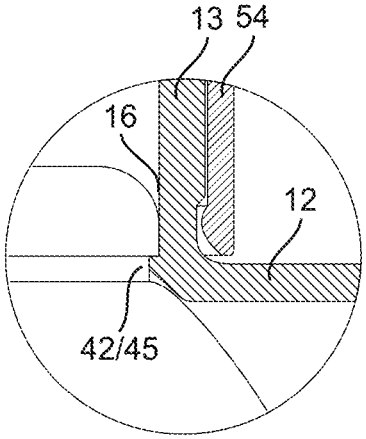
Figure 9:
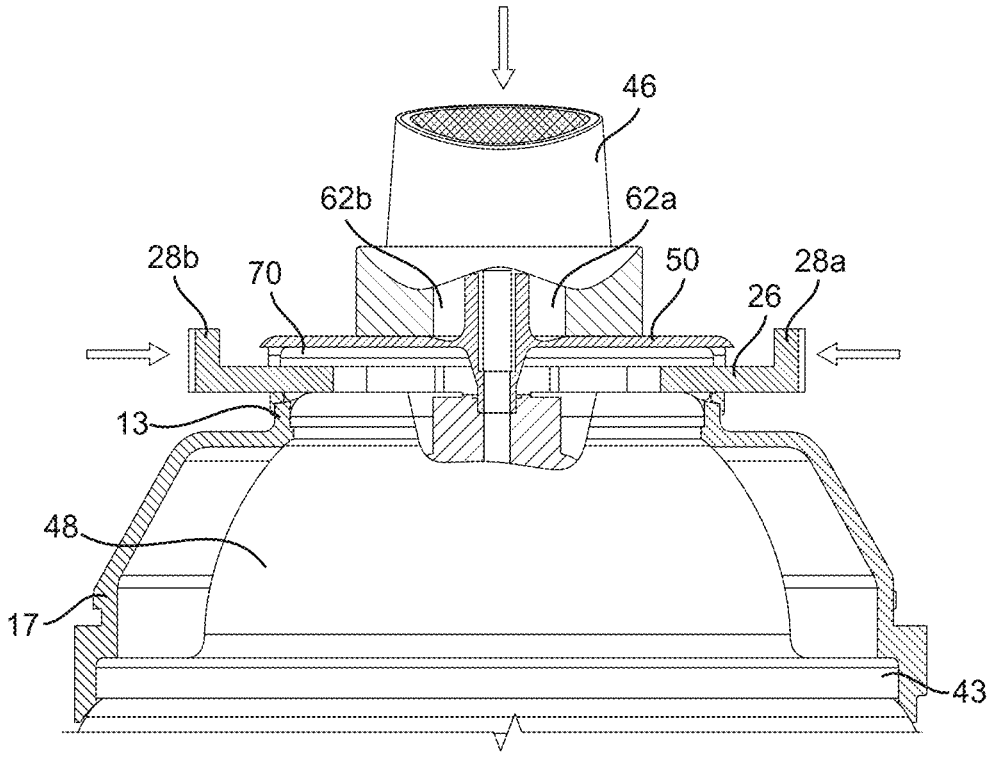
FIG. 9 shows a rear sectional view of another embodiment of the safety valve locking device of the present invention in a rested state.
Figure 10:
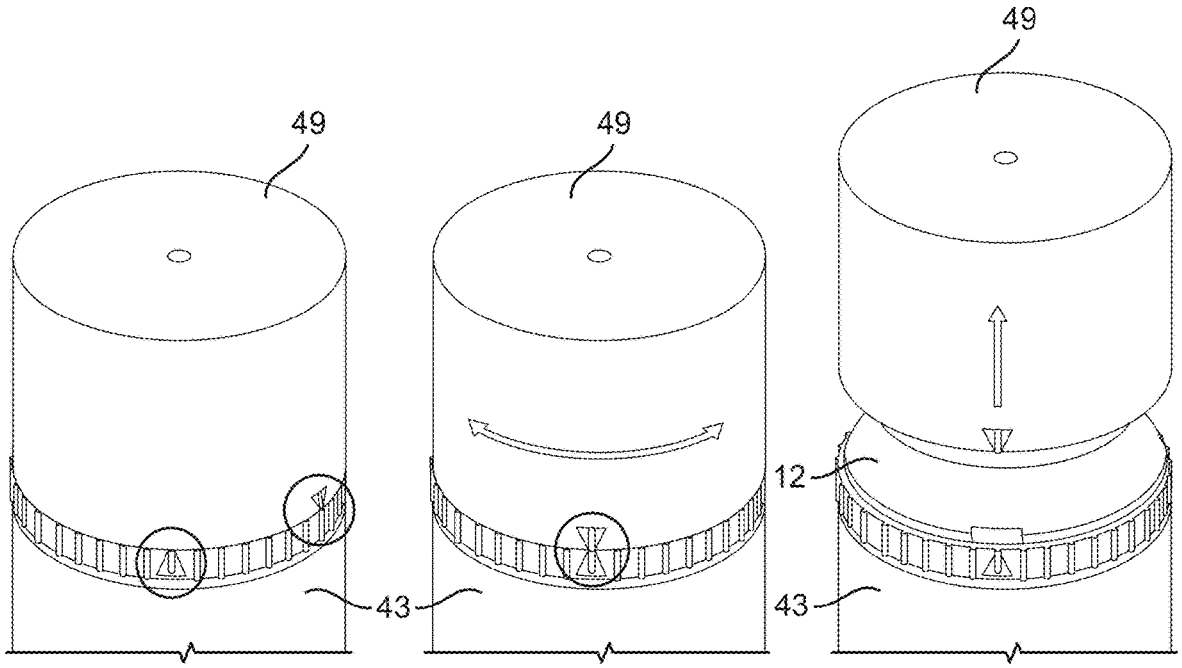
FIG. 10 shows top perspective views of another embodiment of the safety valve locking device of the present invention.

Referring to FIGS. 1A-3B, 7 and 9, in another embodiment, the collar 12 includes generally downwardly extending lower walls 17 with a lower portion thereof configured to be press-fitted with a lip 43 of the can 48. Specifically, the lower portion of the collar 12 is configured as described in the '305 Patent. Moreover, an upper portion of the collar 12 is secured to the rim 42 as shown in FIG. 7. As such, a child-resistant cap 49, as described in the '305 Patent and shown in FIG. 10, is used to provide an extra layer of child-resistance.

Referring to FIGS. 1A-3B, a slide member generally designated 26 is arranged through a central axis of the collar 12. The slide member 26 includes opposing engagement members 28*a*, 28*b* on opposite ends of the slide member 26, extending through respective passageways 40*a*, 40*b* in the collar 12. The slide member 26 includes a longitudinal slot 32 extending between the engagement members 28*a*, 28*b* such that a valve stem 44 extending from a valve assembly of the aerosol can 48 can pass therethrough, as shown in FIGS. 4A-9. Stop tabs 38*a*, 38*b* are provided on the slide member 26 proximate the ends of the longitudinal slot 32 extending laterally outward so that the slide member 26 is restricted from longitudinal movement when the stop tabs 38*a*, 38*b* contact the collar 12. A pair of lateral slots 34*a*, 34*b* are formed at a mid-portion of the longitudinal slot 32 and extend substantially perpendicular across therethrough. Opposing stop members 36*a*, 36*b* are formed between the adjacent lateral slots 34*a*, 34*b* and extend laterally inward such that the opening formed between the stop members 36*a*, 36*b* is less than the opening formed in each of the lateral slots 34*a*, 34*b*.

Figure 3A:
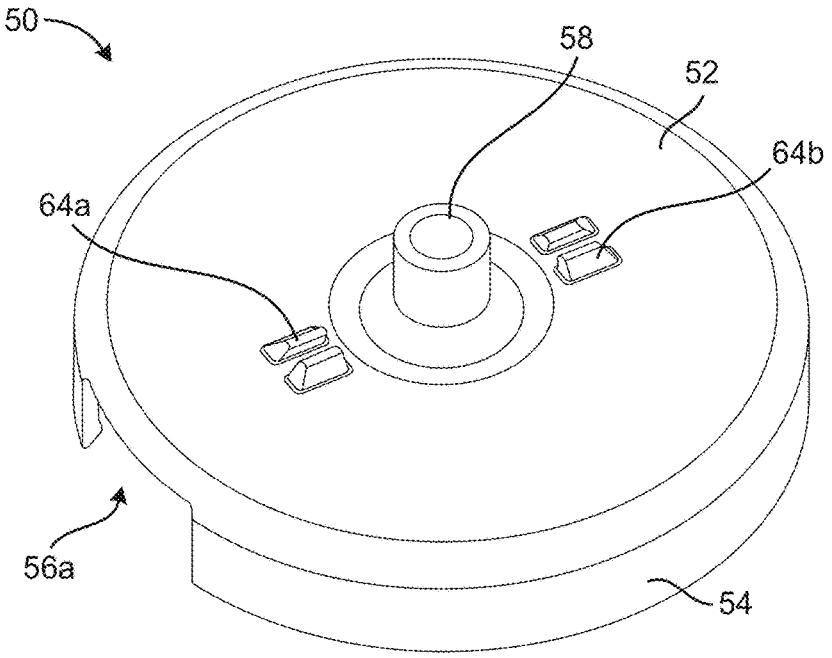
FIGS. 3A and 3B show top perspective views of an intermediate member and a collar, respectively, of the safety valve locking device of FIG. 1.
Figure 3B:
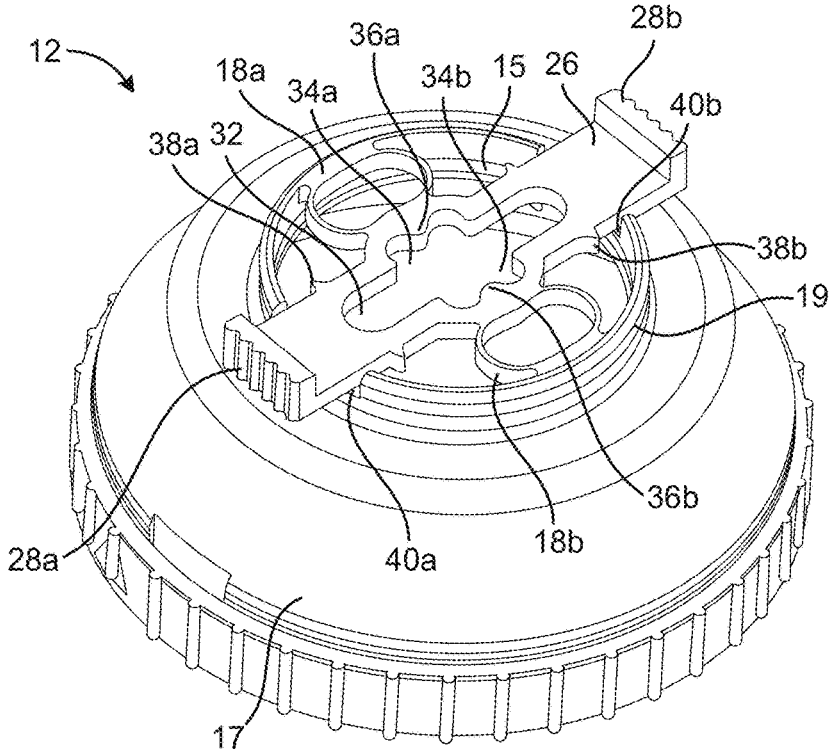

Referring to FIGS. 3A and 3B, the safety valve locking device 10 also includes a pair of biasing members or spring members 18*a*, 18*b* integrally formed on the collar 12 and slide member 26. That is, each of the spring members 18*a*, 18*b* is connected to the inner surface of the collar 12 and to a medial portion of the slide member 26. It is preferable for each of the spring members 18*a*, 18*b* to be symmetrically arranged on opposite sides of the slide member 26. Such an arrangement forms a living-hinge and produces advantageous results with respect to the operation of the present invention which will be discussed more fully hereinbelow.

Referring to FIGS. 1A-3B, the safety valve locking device 10 also includes an intermediate member 50 formed with a top member 52 and side wall 54 extending therefrom. The side wall 54 includes opposing cut-outs 56*a*, 56*b* for accommodating the slide member 26 when assembled. A bottom portion of the side wall 54 includes a detent 55 extending along an inner surface and facing radially inward, as shown, for example, in FIGS. 1A-1C and 4A-6B. As such, the intermediate member 50 is snap-fit onto the collar member 12, with the intermediate member detent 55 positioned under the collar member groove 19. Moreover, the intermediate member detent 55 is slidable on the outer surface 14 of the collar member upper wall 13. The top member 52 includes a top extension 58 and a bottom extension 60 having an aperture extending therethrough. The aperture is sized and shaped to receive and hold the valve stem 44 therein by friction fit and an actuator head 46 is arranged on the valve stem 44 above the top surface of the top extension 58, as shown for example in FIGS. 4A-7. As a result, the valve stem 44 is fixed to the intermediate member 50 such that the intermediate member 50 moves down with the actuator head 46 when the actuator head 46 is depressed, and the intermediate member 50 moves up with the actuator head 46 when the actuator head 46 returns to its upward disengaged position. Furthermore, the position of the actuator head 46 is fixed, i.e., the spray direction is fixed.

Figure 8:
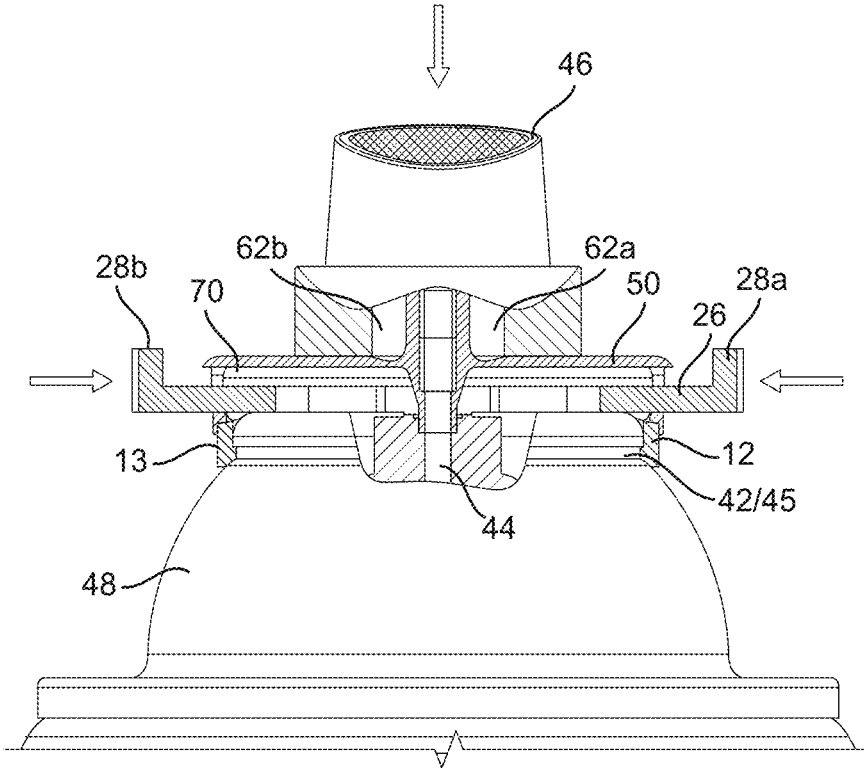
FIG. 8 shows a rear sectional view of another embodiment of the safety valve locking device of the present invention in a rested state.

Still referring to FIGS. 1A-3B, in another embodiment, when a larger actuator head 46 is used, the actuator head 46 includes lower engagement members 62*a*, 62*b* extended downwardly therefrom. In this embodiment, anti-rotation tabs in the form of a pair of detents 64*a*, 64*b* are positioned on opposite sides of the top extension 58. As such, the aperture of the top and bottom extensions 58, 60 hold the valve stem 44 therein by friction fit and the actuator head 46 is further fixed to the intermediate member 50 by engagement of respective lower engagement members 62*a*, 62*b* and corresponding pair of detents 64*a*, 64*b*, as shown in FIGS. 8 and 9. As a result, the valve stem 44 is fixed to the intermediate member 50 such that the intermediate member 50 moves down with the actuator head 46 when the actuator head 46 is depressed, and the intermediate member 50 moves up with the actuator head 46 when the actuator head 46 returns to its upward disengaged position. Furthermore, the position of the actuator head 46 is fixed, i.e., the spray direction is fixed.

Referring again to FIGS. 1A-3B, the intermediate member 50 includes a locking member 66 extending downwardly from a bottom surface thereof and radially outward from the bottom extension 60. The locking member 66 is sized and shaped substantially similar to a lateral slot 34*a*, 34*b* such that the locking member 66 is capable of extending at least partially therethrough.

FIGS. 4A-6B illustrate the safety valve locking device 10 in operation.

Referring to FIGS. 4A, 4B and 7-9, when the safety valve locking device 10 is in a rested state, the intermediate member 50 is biased upward by a biasing member (not shown) positioned on the valve stem 44, as known in the prior art, below the slide member 26. As such, a space 70 is formed between the intermediate member 50 and the slide member 26. The locking member 66 is positioned directly above the stop members 36*a*, 36*b* and unable to move downward. Therefore, when the user applies a downward force to the actuator head 46, the actuator head 46 remains stationary and is unable to discharge any material from the can 48.

Figure 5A:
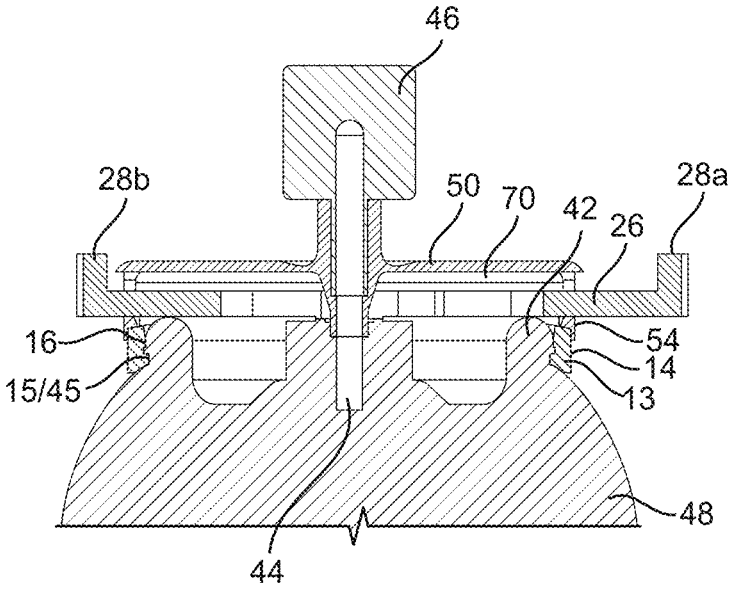
FIGS. 5A and 5B show rear and side sectional views, respectively, of the safety valve locking device of FIGS. 4A and 4B with the slide member engaged.
Figure 5B:
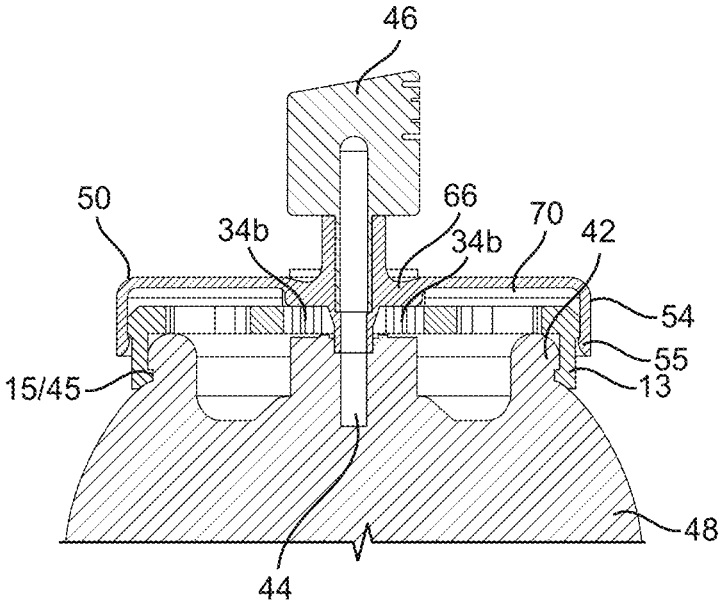
Figure 6A:
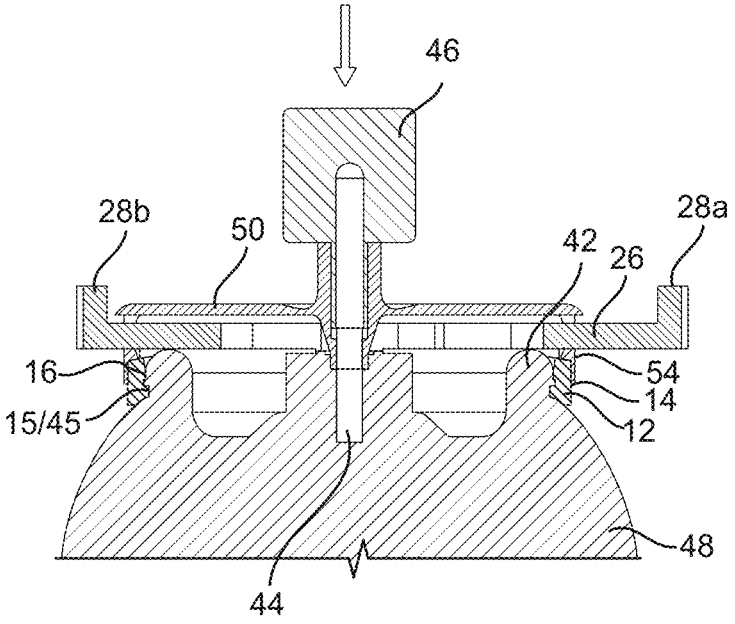
FIGS. 6A and 6B show rear and side sectional views, respectively, of the safety valve locking device of FIGS. 4A and 4B with the slide member and actuator head engaged.
Figure 6B:
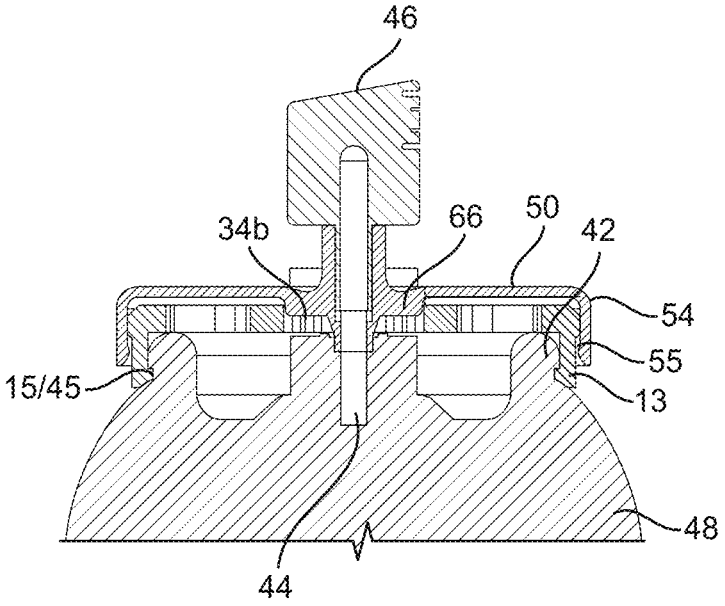

Referring to FIGS. 5A-6B, a right-handed user engages the engagement member 28*b* inward with his right thumb until the opposing stop tab 38*a* engages the collar inner surface 16. At this time, the locking member 66 is vertically aligned with the lateral slot 34*b*, as shown in FIGS. 5A and 5B. The user applies a downward force on the actuator head 46 and the locking member 66 extends through the lateral slot 34*b* while the intermediate member 50 moves downward to close the space 70, as shown in FIGS. 6A and 6B. As a result, material from the can 48 is discharged. For a left-handed user, the user engages the opposite engagement member 28*a* so that the locking member 66 extends through the later slot 34*a*.

Figure 4A:
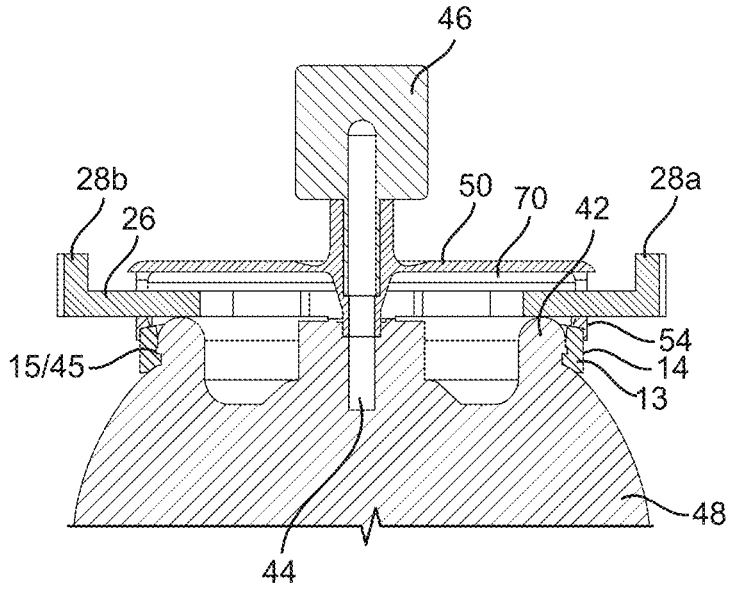
FIGS. 4A and 4B show rear and side sectional views, respectively, of another embodiment of the safety valve locking device of the present invention in a rested state.
Figure 4B:
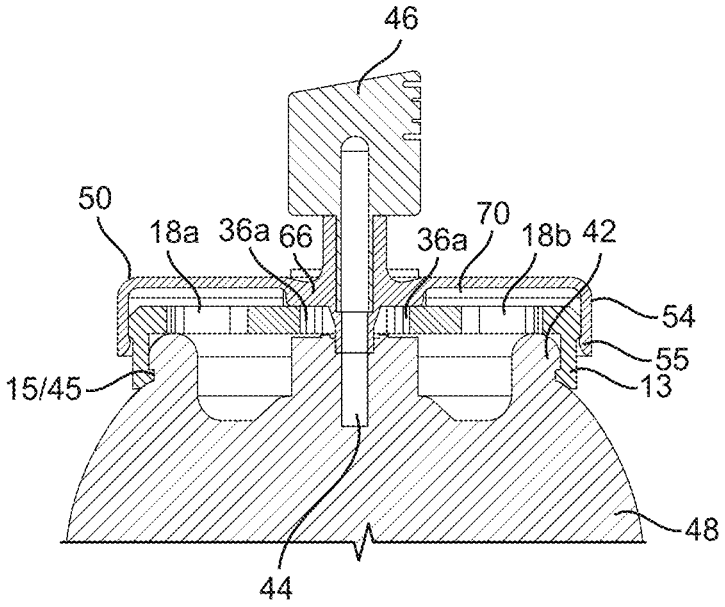

When the user wishes to stop discharge, the actuator head 46 and engagement member 28*a*, 28*b* are disengaged and the valve locking device 10 returns to the rested state, as shown in FIGS. 4A and 4B. The spring members 18*a*, 18*b* provide sufficient force to return the slide member 26 to its position in the rested state, i.e., the locking member 66 positioned above the stop members 36*a*, 36*b*.

As discussed above, the simultaneous application of pressure to the engagement member 28*a*, 28*b* of the slide member 26 and the top of the actuator head 46 requires a level of coordination which can be easily satisfied by an adult. However, the safety valve locking device 10 is truly "childproof" since a young child would not have the coordination to perform such a simultaneous operation and thus, would not be able to operate the device even if taught how to do so by an adult.

As discussed above, further child-resistance could be provided by utilizing the cap locking mechanism described in the '305 Patent and shown in FIG. 10.

As can be appreciated, the slide member 26 and the spring members 18*a*, 18*b* can be manufactured from a wide variety of materials having satisfactory strength and elasticity characteristics. For example, preferred materials include polypropylene, polyethylene and nylon. Preferably, the collar 12 (including the slide member 26 and spring members 18*a*, 18*b*) is manufactured from a single mold and therefore, the collar 12 is also preferably made of polypropylene, polyethylene or nylon. However, other durable plastic materials or suitable polymers could be used. The unique structure and operation of the spring members 18*a*, 18*b* in combination with the slotted portions 32, 34*a*, 34*b* results in advantages over spring members of prior art locking devices, such as increased flexibility and a greatly increased lifespan of the elasticity of the spring members 18*a*, 18*b* and thus a minimal chance of spring failure due to fatigue.

Likewise, the intermediate member 50 is manufactured from a single mold and preferably made of polypropylene, polyethylene or nylon. However, other durable plastic materials or suitable polymers could be used.

Since the safety-valve locking device 10 can be universally used with any standard sized valve rim, such as valve rim 42, it can be sold in convenient packages and can be placed into assembled position in a consumer's home in situations when the manufacturer or the retailer of the product within the aerosol can does not include a safety-locking device as part of the assembled unit.

While the foregoing description and figures are directed toward the preferred device in accordance with the present invention, it should be appreciated that numerous modifications can be made to each of the components of the safety valve locking device as discussed above. The present invention may be embodied in other specific forms without departing from its spirit or essential characteristics. The described embodiments are to be considered in all respects only as illustrative and not restrictive. The scope of the invention will be, therefore, indicated by claims rather than by the foregoing description. All changes, which come within the meaning and range of equivalency of the claims, are to be embraced within their scope.

The invention claimed is:

1. A safety valve locking device comprising:

a collar member configured to be attached to a rim of a can, the collar member comprising: an upper wall comprising inner and outer surfaces; opposing passageways extending through the upper wall, wherein the upper wall inner surface is engaged with the rim; opposing biasing members integrally formed with and extending radially inward from the upper wall inner surface; and a slide member integrally formed with and positioned laterally between the opposing biasing members, the slide member having opposing ends and extending longitudinally through the opposing passageways;

wherein the slide member further comprises: an engagement member extending from each opposing end; a longitudinal slot extending intermediate the opposing ends; a pair of lateral slots formed along the longitudinal slot with a stop member formed between the pair of lateral slots; and at least one stop tab extending laterally outwardly from the slide member;

an intermediate member positioned on the collar member, the intermediate member comprising: a top member having opposing upper and lower surfaces; an upper aperture extending through the top member; a locking member extending downwardly from the lower surface, the locking member configured to be positioned within each of the pair of lateral slots; a side wall extending downwardly from and circumscribing the top member; and first and second opposing cut-outs on the side wall, wherein a bottom end of the side wall is slidably coupled with the collar member upper wall outer surface, and wherein each cut-out is positioned directly above the slide member; and a valve assembly comprising: a vertically extending valve stem; and an actuator head operably coupled to the valve stem at an upper end thereof, wherein the valve stem extends through the upper aperture and into the can, and the actuator head extends above the intermediate member;

wherein in a rested state, the locking member is positioned directly above the stop member such that the intermediate member is prevented from downward movement; and wherein in an engaged state, the engagement member is engaged radially inward such that the locking member is positioned directly above one of the pair of lateral slots, such that when the actuator head is engaged downward, the locking member is positioned within the lateral slot and material from the can is capable of being discharged from the actuator head.

2. The safety valve locking device of claim 1, wherein the collar member further comprises a lower wall extending downwardly from the upper wall.

3. The safety valve locking device of claim 2, wherein a lower end of the lower wall is operably coupled to a lip of the can, wherein the lip is positioned below the rim.

4. The safety valve locking device of claim 3, further comprising a cap, the cap configured to cover the collar member, intermediate member and valve assembly, and further configured to be locked to the collar member lower wall in a child-resistant engagement.

5. The safety valve locking device of claim 1, wherein in the engaged state, the at least one stop tab engages the upper wall inner surface to limit further longitudinal movement of the slide member and to align one of the pair of lateral slots with the locking member.

6. A safety valve locking device comprising:

a collar member configured to be attached to a rim of a can, the collar member comprising: an upper wall comprising inner and outer surfaces; opposing passageways extending through the upper wall, opposing biasing members integrally formed with and extending radially inward from the upper wall inner surface; and a slide member integrally formed with and positioned laterally between the opposing biasing members, the slide member having opposing ends and extending longitudinally through the opposing passageways;

wherein the slide member further comprises: an engagement member extending from each opposing end; a longitudinal slot extending intermediate the opposing ends; and a pair of lateral slots formed along the longitudinal slot with a stop member formed between the pair of lateral slots; and an intermediate member positioned on the collar member, the intermediate member comprising: a top member having opposing upper and lower surfaces; an upper aperture extending through the top member; a locking member extending downwardly from the lower surface, the locking member configured to be positioned within each of the pair of lateral slots; a side wall extending downwardly from and circumscribing the top member; and first and second opposing cut-outs on the side wall, wherein each cut-out is positioned directly above the slide member;

wherein in a rested state, the locking member is positioned directly above the stop member such that the intermediate member is prevented from downward movement; and wherein in an engaged state, the engagement member is engaged radially inward such that the locking member is positioned directly above one of the pair of lateral slots, such that when the intermediate member is engaged downward, the locking member is positioned within the lateral slot and material from the can is capable of being discharged from the can.

7. The safety valve locking device of claim 6, wherein the can further comprises a lip positioned below the rim.

8. The safety valve locking device of claim 7, wherein the collar member further comprises a lower wall extending downwardly from the upper wall.

9. The safety valve locking device of claim 8, wherein a lower end of the lower wall is operably coupled to the can lip.

10. The safety valve locking device of claim 9, further comprising a cap, the cap configured to cover the collar member and the intermediate member, and further configured to be locked to the collar member lower wall in a child-resistant engagement.

11. The safety valve locking device of claim 6, wherein the collar member upper wall inner surface is engaged with the rim.

12. The safety valve locking device of claim 6, wherein a bottom end of the intermediate member side wall is slidably coupled with the collar member upper wall outer surface.

13. The safety valve locking device of claim 6, wherein the slide member further comprises at least one stop tab extending laterally outwardly from the slide member.

14. The safety valve locking device of claim 13, wherein in the engaged state, the at least one stop tab engages the collar member upper wall inner surface to limit further longitudinal movement of the slide member and to align one of the pair of lateral slots with the locking member.

15. A child-resistant assembly comprising:

a collar member configured to be coupled with a container, the collar member comprising: an upper wall comprising inner and outer surfaces; opposing passageways extending through the upper wall, opposing biasing members extending radially inward from the upper wall inner surface; and a slide member positioned laterally between the opposing biasing members, the slide member having opposing ends and extending longitudinally through the opposing passageways;

wherein the slide member further comprises: a longitudinal slot extending intermediate the opposing ends; and a pair of lateral slots formed along the longitudinal slot with a stop member formed between the pair of lateral slots; and an intermediate member positioned on the collar member, the intermediate member comprising: a top member having opposing upper and lower surfaces; and a locking member extending downwardly from the lower surface, the locking member configured to be positioned within each of the pair of lateral slots;

wherein in a rested state, the locking member is positioned directly above the stop member such that the intermediate member is prevented from downward movement; and wherein in an engaged state, the slide member is engaged radially inward such that the locking member is positioned directly above one of the pair of lateral slots, such that when the intermediate member is engaged downward, the locking member is positioned within the lateral slot and material from the container is capable of being discharged from the container.

16. The child-resistant assembly of claim 15, wherein the container comprises a rim, the collar member coupled to the rim.

17. The child-resistant assembly of claim 16, wherein the container further comprises a lip positioned intermediate the rim and a lower portion of the container.

18. The child-resistant assembly of claim 17, wherein the collar member further comprises a lower wall extending downwardly from the upper wall.

19. The child-resistant assembly of claim 18, wherein a lower end of the lower wall is operably coupled to the container lip.

20. The child-resistant assembly of claim 19, further comprising a cap, the cap configured to cover the collar member and intermediate member, and further configured to be locked to the collar member lower wall in a child-resistant engagement.

* * * * *